US012408812B2

(12) United States Patent
Kaltenegger et al.

(10) Patent No.: US 12,408,812 B2
(45) Date of Patent: Sep. 9, 2025

(54) PANEL ASSEMBLY FOR A DISHWASHER, METHOD FOR MOUNTING A PANEL ASSEMBLY, AND DISHWASHER HAVING A PANEL ASSEMBLY OF THIS TYPE

(71) Applicant: BSH Hausgeräte GmbH, Munich (DE)

(72) Inventors: Andreas Kaltenegger, Bachhagel (DE); Stephan Eitel, Ulm (DE); Florian Hirschbolz, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 368 days.

(21) Appl. No.: 18/017,683

(22) PCT Filed: Jul. 27, 2021

(86) PCT No.: PCT/EP2021/070948
§ 371 (c)(1),
(2) Date: Jan. 24, 2023

(87) PCT Pub. No.: WO2022/042975
PCT Pub. Date: Mar. 3, 2022

(65) Prior Publication Data

US 2023/0284863 A1 Sep. 14, 2023

(30) Foreign Application Priority Data

Aug. 25, 2020 (DE) ..... 102020210758.0

(51) Int. Cl.
*A47L 15/42* (2006.01)

(52) U.S. Cl.
CPC ..... *A47L 15/4293* (2013.01); *A47L 15/4257* (2013.01)

(58) Field of Classification Search
None
See application file for complete search history.

(56) References Cited

U.S. PATENT DOCUMENTS

| | | | |
|---|---|---|---|
| 11,497,376 | B2 | 11/2022 | Klaiber |
| 2008/0196749 | A1 | 8/2008 | Kim |
| 2018/0230729 | A1 | 8/2018 | Gherardi |

FOREIGN PATENT DOCUMENTS

| | | | |
|---|---|---|---|
| CH | 683886 | A5 | 6/1994 |
| DE | 602005000881 | T2 | 12/2007 |
| DE | 102014217238 | A1 | 3/2016 |
| DE | 202018100278 | U1 | 1/2018 |
| EP | 3081136 | A1 | 10/2016 |
| WO | 2011085940 | A1 | 7/2011 |

OTHER PUBLICATIONS

National Search Report CN 2021800528398 dated Dec. 31, 2024.
National Search Report DE 102020210758.0 dated Jul. 27, 2021.
International Search Report PCT/EP2021/070948 date Nov. 4, 2021.

*Primary Examiner* — Levon J Shahinian
(74) *Attorney, Agent, or Firm* — Michael E. Tschupp; Andre Pallapies; Brandon G. Braun

(57) ABSTRACT

A composite panel for a dishwasher includes a panel carrier, a first panel element connected to the panel carrier via a first joint arrangement which is arranged in a region of a first inner face of the panel carrier, and a second panel element connected to the panel carrier via a second joint arrangement, which is arranged in a region of a second inner face of the panel carrier. The second panel element has at least one portion in overlapping relation to the first panel element.

20 Claims, 3 Drawing Sheets

PANEL ASSEMBLY FOR A DISHWASHER, METHOD FOR MOUNTING A PANEL ASSEMBLY, AND DISHWASHER HAVING A PANEL ASSEMBLY OF THIS TYPE

CROSS-REFERENCES TO RELATED APPLICATIONS

This application is the U.S. National Stage of International Application No. PCT/EP2021/070948, filed Jul. 27, 2021, which designated the United States and has been published as International Publication No. WO 2022/042975 A1 and which claims the priority of German Patent Application, Serial No. 10 2020 210 758.0, filed Aug. 25, 2020, pursuant to 35 U.S.C. 119 (a)-(d).

The contents of International Application No. PCT/EP2021/070948 and German Patent Application, Serial No. 10 2020 210 758.0 are incorporated herein by reference in their entireties as if fully set forth herein.

BACKGROUND OF THE INVENTION

The invention relates to a composite panel for a dishwasher, in particular a household dishwasher, comprising a panel carrier, a first panel element and a second panel element.

A method for mounting a composite panel for a dishwasher, in particular a household dishwasher, is also proposed, wherein a first panel element and a second panel element are connected to a panel carrier.

Dishwashers, in particular household dishwashers, are known in the prior art and serve principally for cleaning and subsequently drying soiled items to be washed, for example crockery or cutlery. During one or more cleaning steps, the washing liquor (=water or water comprising detergent and/or rinse aid) is applied to the items to be washed in order to release the soiling from the items to be washed. For selecting different cleaning programs and for feedback to a user, for example, the dishwasher generally has control elements at an upper end of a door, such as for example in particular buttons and/or at least one display, wherein the control elements are accessible or visible from above and/or from the front when the door is closed. These control elements are generally arranged in a composite panel which is initially separately mounted during the assembly of the dishwasher and is subsequently connected to the remaining portions of the door. The mounting of the composite panel, which generally consists of a plurality of panel elements, is time-consuming and thus associated with higher production costs.

BRIEF SUMMARY OF THE INVENTION

It is the object of the present invention to develop the known prior art.

The object is achieved by a composite panel and a method for mounting a composite panel having the features of the independent claims.

The composite panel according to the invention for a dishwasher, in particular a household dishwasher, comprises a panel carrier and a first panel element and a second panel element. It is proposed that the first panel element is connected to the panel carrier by means of a first joint arrangement and the second panel element is connected to the panel carrier by means of a second joint arrangement. The first joint arrangement is arranged in the region of a first inner face of the panel carrier and the second joint arrangement is arranged in the region of a second inner face of the panel carrier, which second inner face is preferably opposite from the first inner face. The second panel element overlaps the first panel element at least in some portions.

The composite panel according to the invention can be mounted in a simple and thus cost-effective manner. Preferably, the first panel element is pivoted by means of the first joint arrangement into the panel carrier and fixed therein. Subsequently, the second panel element is pivoted into the panel carrier by means of the second joint arrangement and also fixed. Due to the overlapping of the first panel element by the second panel element, for example, the panel elements can be fixed to one another. As a result, the panel carrier, the first panel element and the second panel element are braced relative to one another and fixed. This permits a rapid and simple mounting of a composite panel which is nevertheless very stable. The mounting can also be preferably carried out without the use of tools.

The panel carrier can be configured, for example, to be substantially box-shaped with a hollow space for the panel elements. The panel carrier can have an open surface over which the panel elements are pivoted in. The first inner face and/or the second inner face can adjoin the open surface, for example. The panel carrier can have, for example, additional openings in order to guide control elements, which are arranged for example on the panel elements, to the outside. The panel carrier, the first panel element and/or the second panel element can consist, for example, of plastic material. Additionally, the panel carrier, the first panel element and/or the second panel element can contain metal elements, for example as a constituent part of electronic assemblies. The second panel element overlaps the first panel element, in particular, such that the first panel element is arranged at least in some portions between the panel carrier and the second panel element.

As already described, the composite panel according to the invention is preferably configured to be mounted on the upper end of a door of a dishwasher. The first panel element and the second panel element are preferably also configured as carriers of functional elements, such as for example control elements or electronic assemblies. Preferably, the composite panel has no further panel elements apart from the first panel element and the second panel element.

According to an advantageous development, it is provided that the first joint arrangement and/or the second joint arrangement comprise in each case at least one joint head and at least one joint head receiver. The corresponding components can be connected to one another by the joint head and the joint head receiver, such that they can be pivoted, in particular, relative to one another during mounting. Different arrangements of the at least one joint head and the at least one joint head receiver are conceivable. For example, the panel carrier can have joint head receivers both for the first joint arrangement and for the second joint arrangement. In this case, the first panel element and the second panel element have respectively corresponding joint heads. However, it is also conceivable that the panel carrier has the joint heads both of the first joint arrangement and of the second joint arrangement. In this case, the first panel element and the second panel element have respectively corresponding joint head receivers. Moreover, it is conceivable that the panel carrier has, for example, the at least one joint head of the first joint arrangement and the at least one joint head receiver of the second joint arrangement. The reverse is also possible, wherein the panel carrier has the at least one joint head receiver of the first joint arrangement and the at least one joint head of the second joint arrangement. In these cases, the panel elements have in each case the at least one corresponding counterpart.

Preferably, the first joint arrangement and/or the second joint arrangement comprise a plurality of joint heads and a plurality of joint head receivers. The plurality of joint heads and joint head receivers of a joint arrangement preferably form a common axis of rotation about which the first panel element or the second panel element is pivotable. The axes of rotation of the first joint arrangement and the second joint arrangement are preferably parallel. The joint head receiver is preferably configured as a recess into which the joint head can be positively inserted, such that preferably at least one rotational degree of freedom is produced. The joint head can be configured, for example, substantially cylindrically, wherein a main axis of the cylinder coincides with the axis of rotation produced when connected to the joint head receiver. The joint head can also be configured to be cuboidal, for example, in particular with rounded edges.

According to an advantageous development, it is provided that the first panel element has a handle and/or a first electronic assembly. As already described, the panel elements preferably serve as carriers for functional subassemblies which, in particular, require separate mounting. In the present case, the panel elements can be advantageously combined with the functional subassemblies to form the composite panel. The handle serves for opening and closing the door of the dishwasher comprising the composite panel. The handle can preferably be configured as a hollow space or recessed grip. Due to the forces which are produced, the handle and/or the surroundings thereof have to be configured to be reinforced. The handle can comprise, for example, an actuating mechanism for unlocking the door of the dishwasher. The first electronic assembly can comprise, for example, a display and possibly a control board corresponding to the display. Connections for connecting to a controller of the dishwasher can also be provided. It is also conceivable that the first electronic assembly comprises control elements for a user of the dishwasher, such as for example buttons.

According to an advantageous development, it is provided that the second panel element has at least one second electronic assembly. The second electronic assembly can also comprise, for example, a display. In particular, the second electronic assembly has control elements for a user of the dishwasher, such as for example buttons. The second electronic assembly can also have a control board for these elements. The first electronic assembly and the second electronic assembly can be connected together, for example, and can also be connected to one another in terms of control.

If both the first electronic assembly and the second electronic assembly have displays and/or control elements for a user, it is conceivable that the displays and/or control elements of the individual electronic assemblies are arranged on different surfaces in the composite panel. In particular, the first electronic assembly of the first panel element can be assigned to the front wall of the panel carrier, and the second electronic assembly of the second panel element can be assigned to the upper side or top wall of the panel carrier when the composite panel is fully mounted on the upper portion of the front door, and the front door adopts its vertical closed end position.

According to an advantageous development, it is provided that the first panel element has at least one first latching element, preferably a plurality of first latching elements, for fastening to the panel carrier. In this manner, when the composite panel is mounted, the first panel element can be fastened in a simple and rapid manner to the panel carrier. Mounting without the use of tools is possible. The latching element is preferably configured either as a latching hook or as a latching edge corresponding to a latching hook. A latching hook in this context is to be understood to mean a component which is configured to be intentionally resilient and which is resiliently deformed during mounting, and in a relaxed state in a dedicated end position positively prevents a movement in at least one direction.

According to an advantageous development, it is provided that the first panel element has at least one second latching element, preferably a plurality of second latching elements, for fastening the second panel element to the first panel element. As a result, when the composite panel is mounted, the second panel element can be fastened in a simple and rapid manner to the first panel element and thereby indirectly to the panel carrier. Preferably, the panel carrier, the first panel element and the second panel element are braced relative to one another and fixed by the at least one first latching element and the at least one second latching element. The at least one second latching element can also be configured as a latching hook or as a latching edge corresponding to a latching hook.

The panel carrier and/or the second panel element can also have at least one latching element. In particular, the panel carrier has at least one third latching element which corresponds to the at least one first latching element. Moreover, the second panel element has, in particular, at least one fourth latching element which corresponds to the at least one second latching element. Corresponding pairs of latching elements can each consist of a latching hook and a latching edge, for example.

According to an advantageous development, it is provided that the at least one first latching element and the at least one second latching element are arranged on two different surfaces of the first panel element which are preferably perpendicular to one another. As a result, the installation space which is available in the panel carrier can be better utilized, for example. A bracing of the components in different directions can also be achieved, whereby ultimately the stability of the composite panel is increased. The first panel element can be substantially configured as a cuboid, for example, with in each case three pairs of surfaces of the same size. The at least one second latching element can be arranged, for example, on one of the surfaces with the largest surface area and the at least one first latching element can be arranged, for example, on one of the surfaces with the second largest surface area.

According to an advantageous development, it is provided that the at least one first latching element and the at least one second latching element are arranged perpendicular to one another in a plan view of the first panel element. Bracing in different directions can also be achieved thereby and thus the stability of the composite panel increased. The perpendicular arrangement is understood to mean, for example, that a resilient deformation of the first latching element and the second latching element takes place in directions perpendicular to one another. The plan view of the first panel element is understood to mean, for example, a view perpendicular to a surface having the largest surface area of the first panel element.

According to an advantageous development, it is provided that the at least one joint head of the first joint arrangement and/or the second joint arrangement is of T-shaped configuration in a plan view of the first panel element and/or the second panel element. This shaping makes it possible to limit the respective joint arrangement to a single axis of rotation in a simple manner. The potential movements of the panel elements relative to the panel carrier are significantly limited thereby. As a result, the mounting of the composite panel is less prone to error.

According to an advantageous development, it is provided that the first panel element and/or the second panel element has at least one retaining element which engages in at least one corresponding recess of the panel carrier. The at least one retaining element ensures, in particular, a stabilizing of the composite panel in the region of the joint arrangements. In particular, the retaining element is designed to avoid the situation where a joint head and a joint head receiver of the joint arrangements are able to be separated from one another after the composite panel has been mounted. The retaining element is configured, for example, as a projection. The recess of the panel carrier can be, for example, an opening in a surface of the panel carrier but can also be configured, for example, by a free space behind an edge in a surface of the panel carrier. In particular, the first panel element and/or the second panel element have a plurality of retaining elements. If the first panel element and/or the second panel element have joint heads, the retaining elements can be arranged, for example, on the same side of the first panel element and/or the second panel element as the joint heads.

According to an advantageous development, it is provided that the first panel element has reinforcing ribs. The reinforcing ribs increase the stability of the first panel element and thereby improve the stability of the composite panel.

The reinforcing ribs are configured, for example, as flat projections perpendicular to a surface of the first panel element with the largest surface area. In order to use the installation space inside the panel carrier as efficiently as possible, the reinforcing ribs are preferably arranged on a side of the first panel element facing away from the second panel element. The reinforcing ribs can be additionally configured, for example, to protect the first electronic assembly from damage.

According to an advantageous development, it is provided that the reinforcing ribs of the first panel element form drainage surfaces for water penetrating into the composite panel. The water used for cleaning the items to be washed in the dishwasher can potentially penetrate into the composite panel and lead to damage of the electronic assemblies. Thus it is advantageous if the reinforcing ribs are configured such that penetrating water is conducted away from the electronic assemblies. A drain can also be provided in the composite panel, for example, said drain returning penetrating water centrally into the interior of the dishwasher. In this case, the reinforcing ribs can be configured, in particular, such that the water is conducted to the drain. One or more of the reinforcing ribs can be arranged, for example, in a roof-shaped manner above the electronic assembly.

According to an advantageous development, it is provided that the reinforcing ribs of the first panel element are of triangular configuration and are arranged in a cascade-like manner on a plurality of levels. As a result, it is possible to achieve an even better drainage of water potentially penetrating into the composite panel. The reinforcing ribs can conduct the penetrating water, for example via the plurality of levels, to the drain which is possibly provided in the composite panel. By way of the triangular configuration, for example, the water can be conducted away from the electronic assemblies. Preferably, the reinforcing ribs are configured as open triangles, wherein preferably a lower face of the triangle remains open. The two sides of the open triangle form, in particular, an obtuse internal angle relative to one another. The respective open triangle is thus configured, in particular, in the shape of a pitched roof. "In a cascade-like manner" is intended to mean here that penetrating water is conducted by the reinforcing ribs of one level onto the reinforcing ribs of a subsequent level.

In particular, in the vertical closed end position of the front door, it can be expedient if, in the fully assembled composite panel which is attached to the upper portion of the front door of a household dishwasher, the second panel element has in each case substantially axially symmetrically on both sides of the center of the width dimension of the composite panel, in particular axially symmetrically on both sides of the central axis of a recessed grip provided in the first panel element, an overlapping projection which overlaps or projects over a rear portion, in particular a wall portion on the rear wall side of the first panel element, when viewed in the vertical direction. In particular, the respective overlapping projection of the second panel element can bear in contact against the wall portion of the first panel element on the rear wall side. Each overlapping projection penetrates into a receiving gap between two respective second latching elements of the first panel element arranged spaced apart from one another in the width direction. It has lateral mating latching elements which face the two second latching elements and which are brought into latching engagement with the second latching elements. In this manner, the second panel element and the first panel element are latched to one another in the region of two overlapping portions arranged axially symmetrically to one another, in order to form an inherently rigid overall assembly, and are secured in position on, or in particular in, the panel carrier via the first latching elements of the first panel element. In particular, by these two overlapping or crossing or intersecting portions which are arranged axially symmetrically to the center of the width dimension of the composite panel, a sufficient surface stability is ensured substantially uniformly over the entire front surface of the composite panel that when a contact pressure is exerted on the front face of the composite panel in the depth direction, a deflection movement of the composite panel in the depth direction, in particular the first panel element thereof, is substantially avoided. This is advantageous, in particular, if the front wall of the panel carrier has a window cutout or a through-hole, in particular approximately centrally, preferably above a recessed grip, behind and/or in which a display which is attached to the front face of the first panel element is positioned. Nevertheless, a sufficient surface rigidity of the composite panel against yielding in the depth direction can be ensured when, for example, a user presses with the finger against the front surface of the composite panel, in particular against the front surface of the display. The latter can occur, in particular, when the display is configured as a touch-sensitive "touch screen".

The composite panel according to the invention can advantageously be fastened to different front doors of household dishwashers, such as for example freestanding dishwashers, semi-integrated dishwashers and fully integrated dishwashers.

The invention further relates to a dishwasher, in particular a household dishwasher, comprising a front door which has a composite panel in the upper region which is configured according to the invention.

In the method according to the invention for mounting a composite panel for a dishwasher, in particular a household dishwasher, a first panel element and a second panel element are connected to a panel carrier. It is proposed that the panel carrier and the first panel element are connected by means of a first joint arrangement and the first panel element is pivoted into the panel carrier and fixed to the panel carrier.

It is also proposed that the panel carrier and the second panel element are subsequently connected by means of a second joint arrangement and the second panel element is pivoted into the panel carrier and fixed to the first panel element. The pivoting mounting of the first panel element and the second panel element permits a simple and cost-effective mounting of the composite panel.

The axes of rotation about which the first panel element and the second panel element are pivoted, are, in particular, parallel to one another. The rotational directions of the pivoting of the first panel element and the second panel element are, in particular, in opposing directions. For example, during mounting, the first element is pivoted clockwise in a side view and the second panel element is pivoted counterclockwise, or vice versa.

Preferably, before the composite panel is mounted, the first panel element and/or the second panel element are provided with functional elements which, in particular, permit a user to operate the dishwasher.

After the composite panel is mounted, the composite panel can be attached, for example, to an upper end of a door of the dishwasher.

According to an advantageous development of the method, it is provided that the first panel element is fixed to the panel carrier by means of at least one first latching element and/or the second panel element is fixed to the first panel element by means of at least one second latching element. A connection by means of latching elements permits a stable connection of the panel elements and the panel carrier and, in particular, mounting without the use of tools.

The panel carrier, the first panel element and the second panel element which are used in this method are configured, in particular, according to the above description, wherein the described features can be implemented individually or in any combination.

BRIEF DESCRIPTION OF THE DRAWINGS

The invention and its advantageous embodiments and developments and the advantages thereof are explained in more detail hereinafter with reference to the drawings. In the drawings, in each case in a schematic basic sketch.

DETAILED DESCRIPTION OF EXEMPLARY EMBODIMENTS OF THE PRESENT INVENTION

Figure 1:
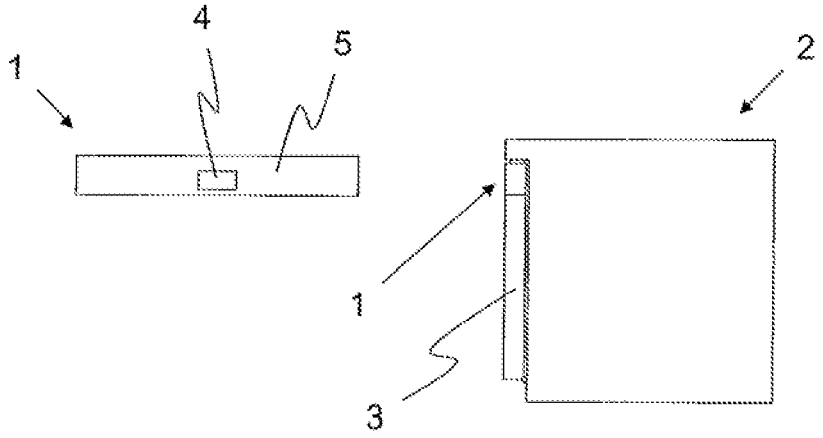
FIG. 1 shows a composite panel in a front view and a dishwasher in a side view.

In the following description of the figures, the same reference characters are used for features which are in each case identical and/or at least comparable in the various figures. The individual features, the design and/or mode of operation thereof are generally explained in detail only when mentioned for the first time. If individual features are not explained again in detail, the design and/or mode of operation thereof corresponds to the design and mode of operation of the already described features which have the same function or the same name.

FIG. 1 shows on the left-hand side a composite panel 1 in a front view and on the right-hand side a dishwasher 2 in a side view. This figure is intended to illustrate the basic shape of the composite panel 1 and the principal arrangement thereof in the dishwasher 2. The composite panel 1 is configured to form the upper portion of a door 3 of the dishwasher 2. The composite panel 1 preferably contains display elements and/or control elements which permit a user to operate the dishwasher 2. For example, the composite panel 1 can have a display 4 which displays, in particular, an operating state of the dishwasher 2. The external appearance of the composite panel 1 in the exemplary embodiment is preferably characterized by a panel carrier 5. The first panel element 6 and the second panel element 7 (see FIG. 2) are arranged in the interior of the panel carrier 5 and thus not generally visible when the dishwasher 2 is finally or fully assembled.

Figure 2:
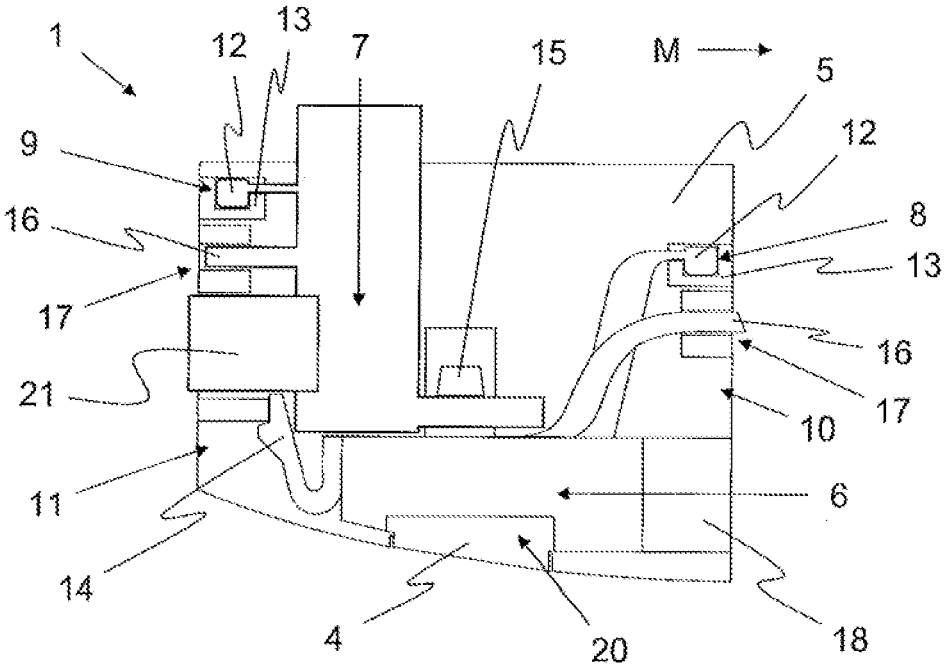
FIG. 2 shows a first sectional side view of the composite panel according to the invention.
Figure 3:
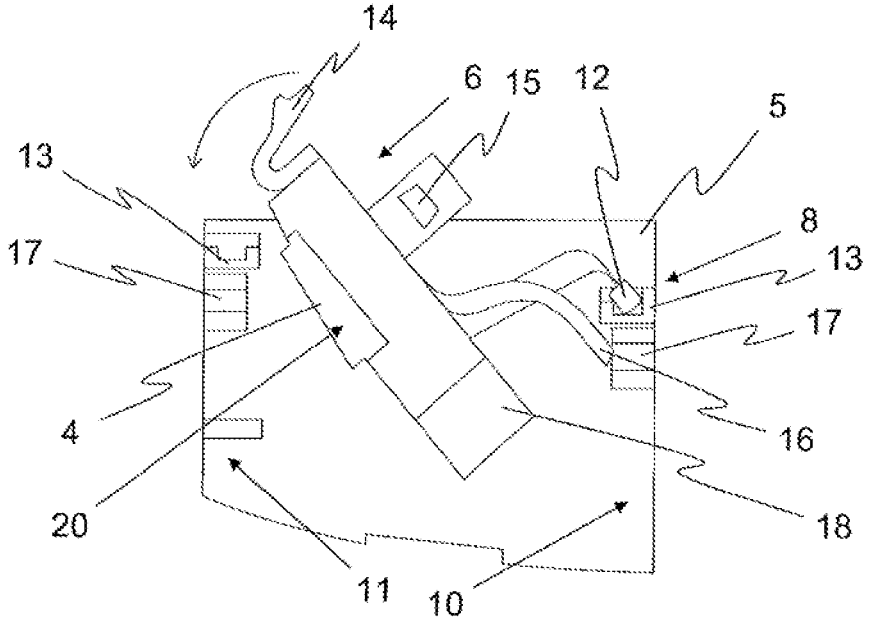
FIG. 3 shows a second sectional side view of the composite panel according to the invention.
Figure 4:
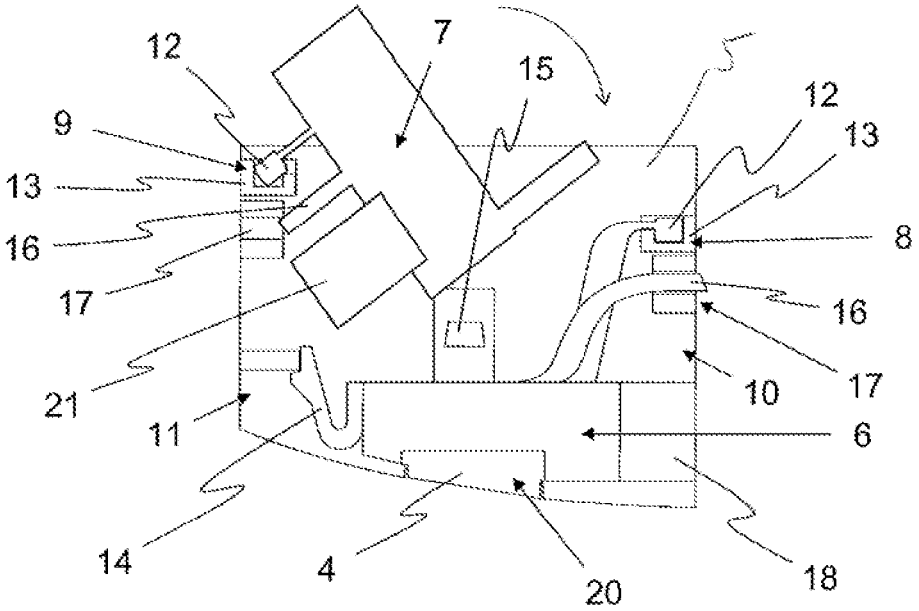
FIG. 4 shows a third sectional side view of the composite panel according to the invention.

FIGS. 2 to 4 show a sectional side view of the composite panel 1. The orientation of these views is such that a mounting of the composite panel 1 can be easily carried out. These side views correspond to the side view of the dishwasher 2 of FIG. 1 but with a rotation of 90° counterclockwise. The mounting direction M in which, after a 90° rotation clockwise, the composite panel 1 would be connected to the door 3 of the dishwasher 2 in a final assembly is provided in FIG. 2 for illustration.

FIG. 2 shows the composite panel 1 made up of the panel carrier 5, the first panel element 6 and the second panel element 7. FIGS. 3 and 4 show the mounting of the composite panel 1, wherein FIG. 3 shows how the first panel element 6 is inserted into the panel carrier 5 and FIG. 4 shows how the second panel element 7 is inserted into the panel carrier 5. By way of FIG. 2 and FIG. 3 it can be identified that the first panel element 6 is connected via a first joint arrangement 8 to the panel carrier 5 and pivoted into the panel carrier 5. To this end, the panel carrier 5 is substantially configured as a hollow space, in particular, wherein in these figures the upwardly oriented side is open for receiving the panel elements 6, 7. It can be identified by way of FIG. 2 and FIG. 4 that the second panel element 7 is connected to the panel carrier 5 and also pivoted into the panel carrier 5 via a second joint arrangement 9.

The first joint arrangement 8 is arranged in the region of a first inner face 10 of the panel carrier 5. The second joint arrangement 9 is arranged in the region of a second inner face 11 of the panel carrier 5. In this exemplary embodiment, the first inner face 10 and the second inner face 11 oppose one another. The second panel element 7 overlaps the first panel element 6 at least in some portions.

In the present example, the first joint arrangement 8 and the second joint arrangement 9 comprise in each case a joint head 12 and a joint head receiver 13. By way of example, the joint head receivers 13 are a constituent part of the panel carrier 5 and the joint heads 12 are constituent parts of the first panel element 6 or the second panel element 7. Other configurations which have already been set forth in the description above are also conceivable. In these views, the joint head receivers 13 are open upwardly in order to receive the joint heads 12 in a simple manner. The joint head receivers 13 substantially form recesses for positively receiving the joint heads 12, wherein a clearance remains, however, for rotating the joint heads 12 about an axis of rotation which is perpendicular to the plane of the figure.

The first panel element 6 is fixed, for example, in the panel carrier 5 by means of a first latching element 14. The first latching element 14 is configured, for example, with a bend so as to be intentionally resiliently deformable. The first latching element 14 acts, for example, positively on a latching edge of the panel carrier 5.

As shown in FIG. 3, the first panel element 6 is connected by means of the first joint arrangement 8 to the panel carrier 5, for example, and pivoted counterclockwise into the panel carrier 5. Subsequently, the first panel element 6 is fixed to the panel carrier 5 by means of the first latching element 14.

The second panel element 7 is fixed, for example, by means of a second latching element 15 to the first panel element 6, wherein the first panel element 6 comprises the second latching element 15. As can be identified in FIG. 4, after the first panel element 6 is mounted, the second panel element 7 is connected to the panel carrier 5 by means of the second joint arrangement 9 and pivoted into the panel carrier 5 clockwise. Subsequently, the second panel element 7 is fixed to the first panel element 6 by means of the second latching element 15. The second latching element 15 acts positively, for example, on a latching edge of the second panel element 7. The first latching element 14 and the second latching element 15 are arranged, for example, on different surfaces of the first panel element 6. In the present example, these surfaces are perpendicular to one another. In a plan view of the first panel element 6, i.e. for example from above in comparison with FIGS. 2 to 4, the first latching element 14 and the second latching element 15 are arranged perpendicular to one another. In particular, during the mounting of the first panel element 6 or the second panel element 7, the first latching element 14 and the second latching element 15 are deformed in directions perpendicular to one another.

The first panel element 6 has a retaining element 16 which is pivoted into a corresponding recess 17 of the panel carrier 5 when the first panel element 6 is pivoted in and, in particular, in the mounted state of the first panel element 6. The retaining element 16 primarily serves to fix the first panel element 6 on the side of the first joint arrangement 8. In particular, a movement of the joint head 12 of the first joint arrangement 8 upwardly out of the joint head receiver 13 is intended to be prevented.

The second panel element 7 also has a retaining element 16 which engages in a corresponding recess 17 of the panel carrier 5 when the second panel element 7 is pivoted in and, in particular, in the mounted state of the second panel element 7. In particular, a movement of the joint head 12 of the second joint arrangement 9 out of the joint head receiver 13 is also intended to be prevented here.

The composite panel 1 can also have the features mentioned in the context of the description of FIGS. 2 to 4, namely the joint head 12, joint head receiver 13, first latching element 14, second latching element 15, retaining element 16 and recess 17, in particular also repeatedly.

The first panel element 6 has, for example, a handle 18 which is preferably substantially configured as a hollow space or recessed grip for the fingers of a user of the dishwasher 2. The panel carrier 5, for example, also has a corresponding opening 19 for the handle 18 (see FIG. 6). In order to enable the user to reach into the handle 18, the door 3 of the dishwasher 2 preferably also has a corresponding opening 19. The first panel element 6 has, for example, a first electronic assembly 20 which comprises, in particular, the display 4. It is also conceivable that the first electronic assembly 20 comprises further control elements.

The second panel element 7 comprises, for example, a second electronic assembly 21. The second electronic assembly 21 can have, in particular, control elements for controlling the dishwasher 2, such as for example buttons. Additionally, the second electronic assembly 21 can also comprise an additional display 4. It is conceivable that the control elements of the first electronic assembly 20 and the second electronic assembly 21 are arranged on different surfaces of the composite panel 1. The panel carrier 5 has, in particular, openings 19 (see FIG. 6) for the control elements of the first electronic assembly 20 and the second electronic assembly 21.

Figure 5:
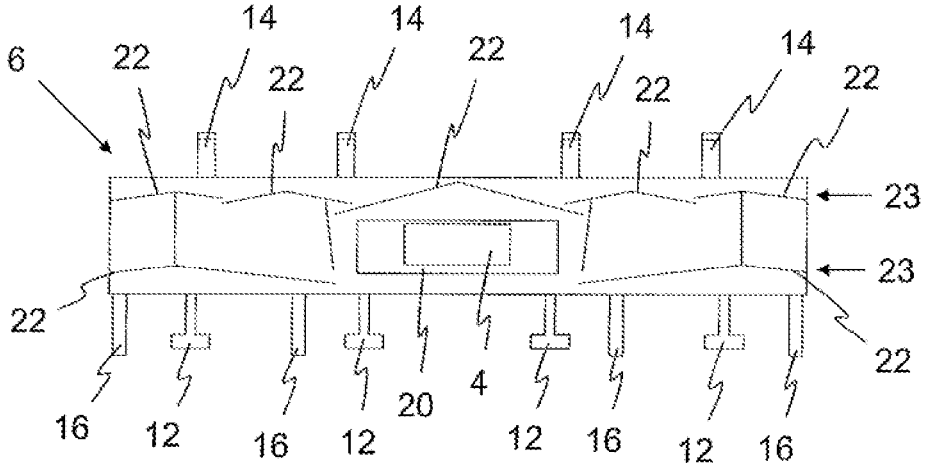
FIG. 5 shows a plan view of the first panel element.

FIG. 5 shows a plan view of the first panel element 6 and namely viewed from below in the perspective of FIGS. 2 to 4. For example, the centrally arranged first electronic assembly 20 with the display 4 can be clearly identified. A plurality of first latching elements 14 are arranged on the upper side surface. A plurality of retaining elements 16 are arranged on the lower side surface. A plurality of joint heads 12 are also arranged on the lower side surface. In this plan view, the joint heads 12, for example, are of T-shaped configuration. This shaping permits a stable pivoting of the first panel element 6 exclusively around one axis of rotation. For example, the first latching elements 14, the retaining elements 16 and the joint heads 12 are arranged offset to one another.

The first panel element 6 also has reinforcing ribs 22 which in the view of FIG. 5 are arranged perpendicular to the plane of the figure. The reinforcing ribs 22 ensure, on the one hand, increased stability of the first panel element 6. Moreover, the reinforcing ribs 22 are arranged, in particular, such that they form drainage surfaces for water penetrating into the composite panel 1. To this end, the reinforcing ribs 22 are configured, for example, as open triangles. In particular, the reinforcing ribs 22 protect the first electronic assembly 20 from penetrating water. The reinforcing ribs 22 are arranged, for example, in a cascade-like manner on a plurality of levels 23. Water can be conducted thereby, for example, past the first electronic assembly 20 to a drain, not shown.

Figure 6:
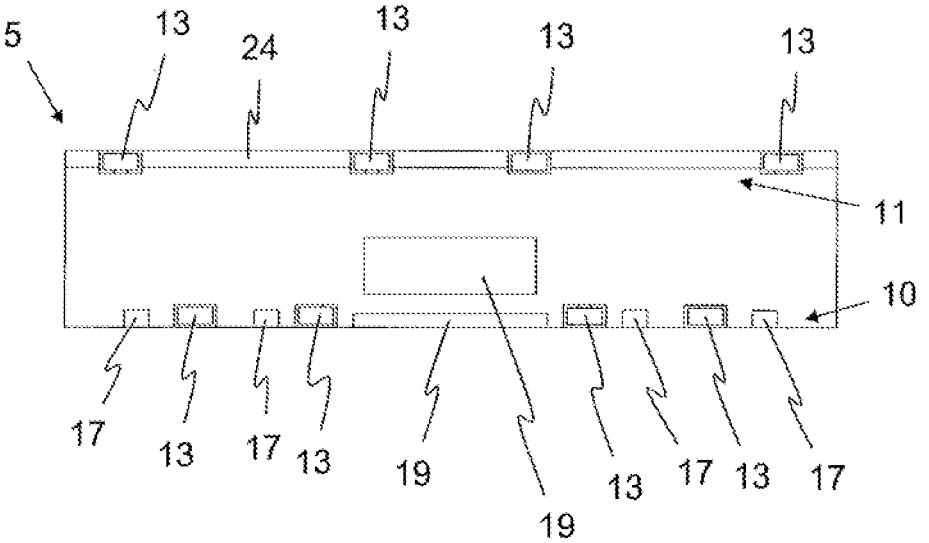
FIG. 6 shows a plan view of the panel carrier.

For illustrating the essential structure of the panel carrier 5, FIG. 6 shows a plan view of the panel carrier 5 and namely in the perspective of FIGS. 2 to 4, when viewed from above. A plurality of joint head receivers 13 of the first joint arrangement 8 are arranged in the region of a first inner face 10 of the panel carrier 5. A plurality of joint head receivers 13 of the second joint arrangement 9 are arranged in the region of a second inner face 11, preferably opposing the first inner face 10.

A plurality of recesses 17 for the retaining elements 16 of the first panel element 6 are also arranged in the region of the first inner face 10. In this exemplary embodiment, a recess 17, not shown, is provided by an edge 24 for the retaining elements 16 of the second panel element 7. The panel carrier 5 also has openings 19 for the display 4 of the first electronic assembly 20 or for the handle 18.

Finally, a few points of the present invention should be explained once again, wherein if required the following features can be implemented individually or in any combination (if technically possible and expedient).

The invention permits a simple and rapid mounting of different components in a composite panel.

The first panel element is inserted into bearing points which are incorporated in the panel carrier. Subsequently, using a pivoting movement the first panel element is mounted in the panel carrier. The mounting process for the second panel element is implemented according to the same principle. On the opposing side, bearing points are also incorporated in the panel carrier for the second panel element. This second panel element is inserted into the bearing points. Now a pivoting movement takes place with the second panel element onto the first panel element. The components are fixed together by means of the snap hooks, bearing points and reinforcing ribs.

Advantages:

cost-effective and simple mounting principle without additional components or tools, stable and resilient construction principle, since components are braced against one another, simple, rapid and reliable mounting, including poka-yoke.

Moreover, the invention is not limited to the exemplary embodiments shown. Rather, all combinations of the described individual features as shown or described in the claims, the description and the figures, and as long as a corresponding combination is technically possible or appears expedient, form the subject of the invention. In particular, the composite panel according to the invention is not only able to be mounted on the front door of a semi-integrated household dishwasher or a so-called "stand-alone" household dishwasher, in which in each case generally the front wall of the panel carrier is visible to a user from outside, but also on other front doors such as for example a fully integrated household dishwasher. In a fully integrated household dishwasher, the entire front of the front door is covered by a furniture panel which is preferably adapted to the design of the adjacent kitchen furniture or corresponds thereto.

The invention claimed is:

1. A composite panel for a dishwasher, comprising:

a panel carrier;

a first panel element arranged in an interior space of the panel carrier and connected to the panel carrier via a first joint arrangement which is arranged in a region of a first inner face of the panel carrier; and a second panel element arranged in the interior space of the panel carrier and connected to the panel carrier via a second joint arrangement, which is arranged in a region of a second inner face of the panel carrier, said second panel element having at least one portion in overlapping relation to the first panel element.

2. The composite panel of claim 1, constructed for a household dishwasher.

3. The composite panel of claim 1, wherein the second inner face is opposite from the first inner face.

4. The composite panel of claim 1, wherein at least one of the first and second joint arrangements comprises a joint head receiver and a joint head received in the joint head receiver.

5. The composite panel of claim 4, wherein the joint head of at least one of the first and second joint arrangements is of T-shaped configuration in a plan view of the corresponding one of the first and second panel elements.

6. The composite panel of claim 1, wherein the first panel element comprises a handle and/or an electronic assembly.

7. The composite panel of claim 1, wherein the second panel element comprises an electronic assembly.

8. The composite panel of claim 1, wherein the first panel element comprises at least one first latching element for fastening to the panel carrier.

9. The composite panel of claim 8, wherein the first panel element comprises at least one second latching element for fastening the second panel element to the first panel element.

10. The composite panel of claim 9, wherein the first latching element and the second latching element are arranged on two different surfaces of the first panel element.

11. The composite panel of claim 10, wherein the two different surfaces of the first panel element are perpendicular to one another.

12. The composite panel of claim 9, wherein the first latching element and the second latching element are arranged perpendicular to one another in a plan view of the first panel element.

13. The composite panel of claim 1, wherein at least one of the first and second panel elements comprises a retaining element which engages in a corresponding recess of the panel carrier.

14. The composite panel of claim 1, wherein the first panel element comprises reinforcing ribs.

15. The composite panel of claim 14, wherein the reinforcing ribs of the first panel element form drainage surfaces for water penetrating into the composite panel.

16. The composite panel of claim 14, wherein the reinforcing ribs of the first panel element are of triangular configuration and are arranged in a cascade-like manner on a plurality of levels.

17. A dishwasher, comprising:

a front door; and a composite panel provided in an upper region of the door, said composite panel comprising a panel carrier, a first panel element arranged in an interior space of the panel carrier and connected to the panel carrier via a first joint arrangement which is arranged in a region of a first inner face of the panel carrier; and a second panel element arranged in the interior space of the panel carrier and connected to the panel carrier via a second joint arrangement, which is arranged in a region of a second inner face of the panel carrier, said second panel element having at least one portion in overlapping relation to the first panel element.

18. The dishwasher of claim 17, constructed in a form of a household dishwasher.

19. A method for mounting a composite panel for a dishwasher, comprising:

connecting a first panel element to a panel carrier via a first joint arrangement;

pivoting the first panel element into an interior space of the panel carrier;

fixing the first panel element to the panel carrier;

connecting a second panel element to a panel carrier via a second joint arrangement;

pivoting the second panel element into the interior space of the panel carrier; and fixing the second panel element to the panel carrier.

20. The method of claim 19, wherein the first panel element is fixed to the panel carrier by a first latching element and/or the second panel element is fixed to the first panel element by a second latching element.

* * * * *